US006361446B2

(12) United States Patent
Lawson et al.

(10) Patent No.: US 6,361,446 B2
(45) Date of Patent: Mar. 26, 2002

(54) AUTOMATED SWINGING DEVICE

(76) Inventors: Sydney William Lawson; Ronald David Lawson, both of 539 Kinney Mill Rd., Mt. Airy, GA (US) 30563

( * ) Notice: Subject to any disclaimer, the term of this patent is extended or adjusted under 35 U.S.C. 154(b) by 0 days.

(21) Appl. No.: 09/792,218

(22) Filed: Feb. 22, 2001

Related U.S. Application Data

(63) Continuation-in-part of application No. 09/540,392, filed on Mar. 31, 2000, now Pat. No. 6,254,490.

(51) Int. Cl.[7] ..... A63G 9/16
(52) U.S. Cl. ..... 472/119; 297/273; 472/125
(58) Field of Search ..... 472/118–125; 297/273–275, 276, 277, 281; 5/109; 310/78, 92

(56) References Cited

U.S. PATENT DOCUMENTS

| | | | | | |
|---|---|---|---|---|---|
| 3,842,450 | A | | 10/1974 | Pad | 5/109 |
| 4,491,317 | A | * | 1/1985 | Bansal | 472/119 |
| 4,911,429 | A | | 3/1990 | Ogbu | 272/86 |
| 5,139,462 | A | * | 8/1992 | Gabe | 472/119 |
| 5,378,196 | A | * | 1/1995 | Pinch et al. | 472/119 |
| 5,574,339 | A | | 11/1996 | Kattwinkel et al. | 318/10 |
| 5,833,545 | A | * | 11/1998 | Pinch et al. | 472/119 |
| 5,846,136 | A | | 12/1998 | Wu | 472/119 |

* cited by examiner

*Primary Examiner*—Kien T. Nguyen
(74) *Attorney, Agent, or Firm*—Carnes, Cona & Dixon

(57) ABSTRACT

The present invention provides for an automatic swinging device with a natural rhythm of the swinging motion that is designed and configured to be coupled to any desired apparatus that can be sat on and in which the user wishes to be swung automatically, if desired, and manually, when desired. The present invention is an apparatus that can be attached to any device so as to provide for a final product that not only provides an automatic swinging motion having natural rhythm, but also provides for a unit that allows the user to swing naturally, when desired, so as to prevent hindrance of free swing, and to adjust the angle of the automatic swing motion. In an optional configuration, the present invention can include an attachment element that will eliminate wobbling during the swing motion, a feature generally associated with conventional swings. To enable such a configuration, the swing device of the present invention comprises a driving unit, an actuating unit, and a power unit. The driving unit provides the pushing pulling force for enabling the appropriate swing for the article that is attached to the present invention. The actuating unit initiates and terminates the swinging process as desired by the user. The power unit supplies power to the assembly.

17 Claims, 9 Drawing Sheets

AUTOMATED SWINGING DEVICE

This is a continuation-in-part of patent Ser. No. 09/540,392 filed on Mar. 31, 2000 now U.S. Pat. No. 6,254,490.

BACKGROUND OF THE INVENTION

1. Field of the Invention

The present invention relates to a unique and useful automatic swinging device and more particularly to a swinging device that will maintain the natural rhythm of the swinging motion without the feel of any forced motion or any effort from the passenger, while providing for an automatic swinging device that can accommodate any type and size of leisure furniture desired to be swung, regardless of its length and size. The present invention is so designed to provide for a device that can be secured to any product so as to inherently provide an apparatus that not only provides for an automatic natural swinging rhythm of the particular product, but also includes a means of adjusting the angle of automatic swing, a means of eliminating wobbling that may occur during the swinging process, while still enable free swing (non-automatic) to occur when desired.

2. Description of the Prior Art

The relaxation afforded by sitting and swinging on a porch swing is unsurpassed as one of life's great pleasures. U.S. Pat. No. 5,846,136 issued to Wu discloses a swing chair device for young children which has a simplified control/drive mechanism. However, this device has no natural swinging rhythm, no angular or magnitude adjustment, cannot swing independent of the motor control mechanism and has forced unnatural motion forward and backwards. In addition, the swing chair device is uncomfortable due to a maintained fixed motion, as well as noisy due to the drive mechanism being at nearly head-level and close to the user's ear. U.S. Pat. No. 5,574,339 issued to Kattwinkel et al discloses a typical prior art swing device for rocking furniture. Although U.S. Pat. No. 5,574,339 discloses natural rhythm and magnitude or angular adjustment, this device has limited magnitude adjustment, features limited movement and features friction losses due to the backwards freewheeling motor during 100% of the return cycle. Furthermore, since the swing is mechanically connected 100% of the time with the motor, wheel and bar, true natural rhythm cannot be achieved since the passengers mass and momentum would have to rotate through the rack and pinion arrangement during conventional swinging (without the motor/controller device). In addition, this device uses microprocessors and sensors which increase the chance for simple electronic failures, both are very susceptible to lightning damage and both require specialized parts for replacement.

U.S. Pat. No. 4,911,429 issued to Ogbu is also another prior art device, however it provides no magnitude adjustment and also does not provide for natural rhythm in the swing. The disadvantages of this device include an unsightly and bulky device for any kind of furniture, duplicate motor/drive mechanisms for each side of the device and having to maintain a battery charge.

In addition, the device in question will have pronounced wobbling if there are any minuet differences in the motor characteristics such as speed or wattage/horsepower. U.S. Pat. No. 3,842,450 issued to Pad disclose a typical prior art swing device for rocking furniture. Although U.S. Pat. No. 3,842,450 discloses natural rhythm and angular adjustment, it is somewhat crude producing a loud impacting and humming noise as a result of the plunger on a solenoid engaging. Also, over-swinging during a light swing setting would result in mechanical restrictions resulting in pronounced discomfort. Additionally, varying weights of the passenger will change the angle of the swing appreciably.

As seen, there is a pressing need for a unique and useful automatic swing device that can be attached or retrofitted to furniture, such as benches, chairs, or the like, that are desired to be swung. This unit should be simple in design and structure so as to efficiently enable swinging to commence when desired. The unit should be designed so as to accommodate any size of furniture, regardless of length. The swinging motion should be such that the passenger can maintain the natural rhythm of the swinging motion without the feel of any forced motion or any effort.

As seen, none of these previous efforts provide the benefits intended with the present invention or method, by providing for an automatic swinging device that can be attached to any item that is desired to be swung. The present invention provides a product that is directly marketable to the consumer. Additionally, prior techniques do not suggest the present inventive combination of component elements as disclosed and claimed herein.

As will be seen, the present invention achieves its intended purposes, objectives and advantages by accomplishing the needs as identified above, through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for an automatic swinging device with a natural rhythm of the swinging motion that is designed and configured to be coupled to any desired apparatus, such as, but not limited to; benches, chairs, leisure furniture, swings, hammocks, lounge chairs, reclining furniture, therapeutic furniture, cribs, bassinet, beds, rope swings, tanning beds, sofas, park benches, rideable stuffed animals, bean bag, or the like, in which the user wishes to be swung automatically, if desired, and manually, when desired. The present invention is an apparatus that can be attached to any device so as to provide for a final product that not only provides an automatic swinging motion having natural rhythm, but also provides for a unit that allows the user to swing naturally, when desired, so as to prevent hindrance of free swing, and to adjust the angle of the automatic swing motion. In an optional configuration, the present invention can include an attachment element that will eliminate wobbling during the swing motion, a feature generally associated with conventional swings.

To enable such a configuration, the swing device of the present invention comprises a driving unit, an actuating unit, and a power unit. The driving unit provides the pushing pulling force for enabling the appropriate swing for the article that is attached to the present invention. The actuating unit initiates and terminates the swinging process as desired by the user. The power unit supplies power to the assembly.

The driving unit includes a clutch system for allowing adequate swing, as well as includes a driven unit that will aid in the providing a smooth and rhythmic swing pattern. In rendering an apparatus that can be attached to any size article, the driving unit can include a main driving unit and floating unit, wherein each include a hanging arm that will receive and support a conventional holding element, generally utilized with swing seat apparatus, such as a chain, rod, rope or the like, of the seat apparatus. This will provide for the main drive unit and floating unit to maintain the seat apparatus in an elevated position, via the conventional holding element, so as to provide for a raised seat capable of being swung.

The driving unit also includes a means of enabling natural swing, so that when it is desired to swing naturally, not automatically, the user can readily swing freely. Thereby providing an apparatus that does not hinder free swing, but rather, provides for a device that will be adapted to operate independently of the automatic swing motion when desired.

To further enhance the product a swing angle adjustment can be provided. This angle adjustment will enable the user to adjust the angle of swing so as to innately provide a means of magnitude adjustments. This magnitude adjustment will ultimately provide a device that can be customized to the user's desired swing path at the desired height and speed.

For eliminating wobbling, generally associated with conventional swings or swinging device, an optional shaft can be provided. This shaft will be coupled to the main driving unit and the floating unit. The shaft will provide the necessary stability needed to eliminate any and all wobbling or movement generally associated with conventional swinging device.

Accordingly, one of the primary objects of the present invention is to design and configure a novel, useful and unobvious swing device that can be coupled to any desired conventional article, such as, but not limited to, swings, benches, seats, chairs, leisure furniture, or the like, which will render continuous swing, when desired, and at an unimpeded natural rhythm requiring no effort by the user.

Yet another object of the present invention is to provide for a swinging device, which can be coupled to any conventional article, one that will overcome the deficiencies, shortcomings, and drawbacks of prior swinging devices and methods thereof.

Still another object of the instant invention is to provide for a swing device that will render a smoother and quieter ride, when compared to conventional swinging units, and in addition, will be adapted to operate independently of the automatic swing motion when desired.

Another object of the present invention is to provide for a swing device that includes a means of magnitude adjustments, so as to alter and ultimately provide a device that can be customized to the user's desired swing path at the desired height and speed.

A further object of the present invention is to design and configure a swing device that can successfully and efficiently produce a constant swing having natural rhythm while providing an overall unit having minimal electrical components so as to provide for a device that will inherently reduce costly repair/service calls generally associated with units having complex and/or several electrical and mechanical components.

Another object of the present invention is to minimize the duration of the added energy produced by the swing assembly of the swing device, which is necessary to maintain the swinging motion, to only a fraction of the complete cycle. Therefore if anything were to be felt by the passenger, it would only be momentary and the rest of the cycle will be natural motion, free of any mechanical interference.

Still a further object of the present invention, to be specifically enumerated herein, is to provide a swing device in accordance with proceeding objects and which will conform to conventional forms of manufacture, be of simple construction and easy to use so as to provide a device that would be economically feasible, long lasting and relatively trouble free in operation.

Although there have been many inventions related to swing devices, none of the inventions have become sufficiently compact, low cost, reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and applications of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DETAILED DESCRIPTION OF THE PREFERRED EMBODIMENT

Figure 1A:
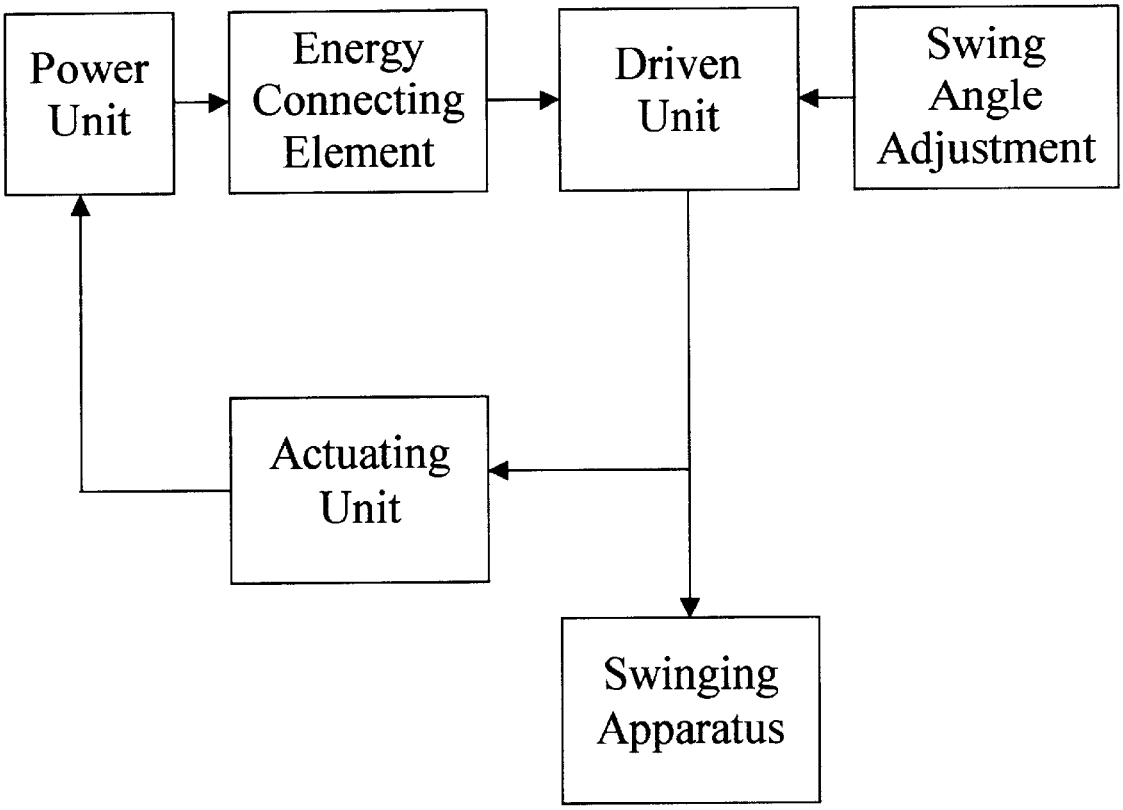
FIG. 1*a* is a block diagram of the components used for the automatic swing device of the present invention.

With reference to the drawings and in particular to FIG. 1*a*–8 thereof, an automatic swinging device constructed in accordance with the present invention, generally denoted by reference numeral 10 (see FIG. 1*b*), is shown. This automatic swing device of the present invention is designed and configured to be attached to a conventional seat apparatus, such as a bench or the like. This will provide for the device to support the seat apparatus in an elevated position so as to permit swinging to commence. In an alternative embodiment, the present invention can be located on the base of a conventional seat device designed to rock. This will provide for the present invention to rock the seat automatically when desired and also allow for the user to rock the chair manually when desired. This will provide for the seat to be located on the ground and not necessitate for the seat to be in an elevated position. Consequently rendering an apparatus that is versatile and one that can be secured to any type or style of seat apparatus so as to enabling rocking or swinging to commence as desired by the user.

The present invention, when coupled to the seat apparatus, will enable swinging to occur automatically when desired or, optionally, manually, if so desired. This will provide for a final product ideally suited for use with any style or type of seating apparatus, such as, but not limited to; benches, chairs, leisure furniture, swings, hammocks, lounge chairs, reclining furniture, therapeutic furniture, cribs, bassinet, beds, rope swings, tanning beds, sofas, park benches, rideable stuffed animals, bean bag, or the like, in which the user wishes to be swung automatically, if desired, and manually, when desired or the like. The use of such a device will enhance conventional seating apparatus by providing a final product that produces a natural rhythm of the swinging motion without the feel of any forced motion or any effort from the passenger. The unit is compact in size and dimension so as to provide for a final product that is non-obtrusive to the consumer and ultimately adding to the comfort but not diminishing the aesthetics of the conventional seat apparatus.

To allow for automatic swing to occur, the present invention, as seen in FIG. 1*a* comprises a power unit that is coupled to a driven unit via an energy-connecting element. This driven unit is coupled to the conventional swinging apparatus (i.e. bench, chair or the like). An actuating unit is located between the driven unit and power unit, for initiating each swing cycle. The power unit is structured so as to produce a pushing or pulling force so as to enable the seat to swing (or rock). The energy-connecting element is a mechanical element that renders power to be transferred from the power unit to the driven unit. The driven unit dampens power so as to provide for a smoother motion and thus provide for a natural rhythm of the swinging motion. The actuating unit initiates the energy cycle so as to enable the user the option of swinging automatically or manually when desired. Optionally, to enhance the present invention, a swing angle adjustment can be provided. This will allow the user to adjust the angle of the swing. Innately providing the option of a high swing or low swing.

Figure 1B:
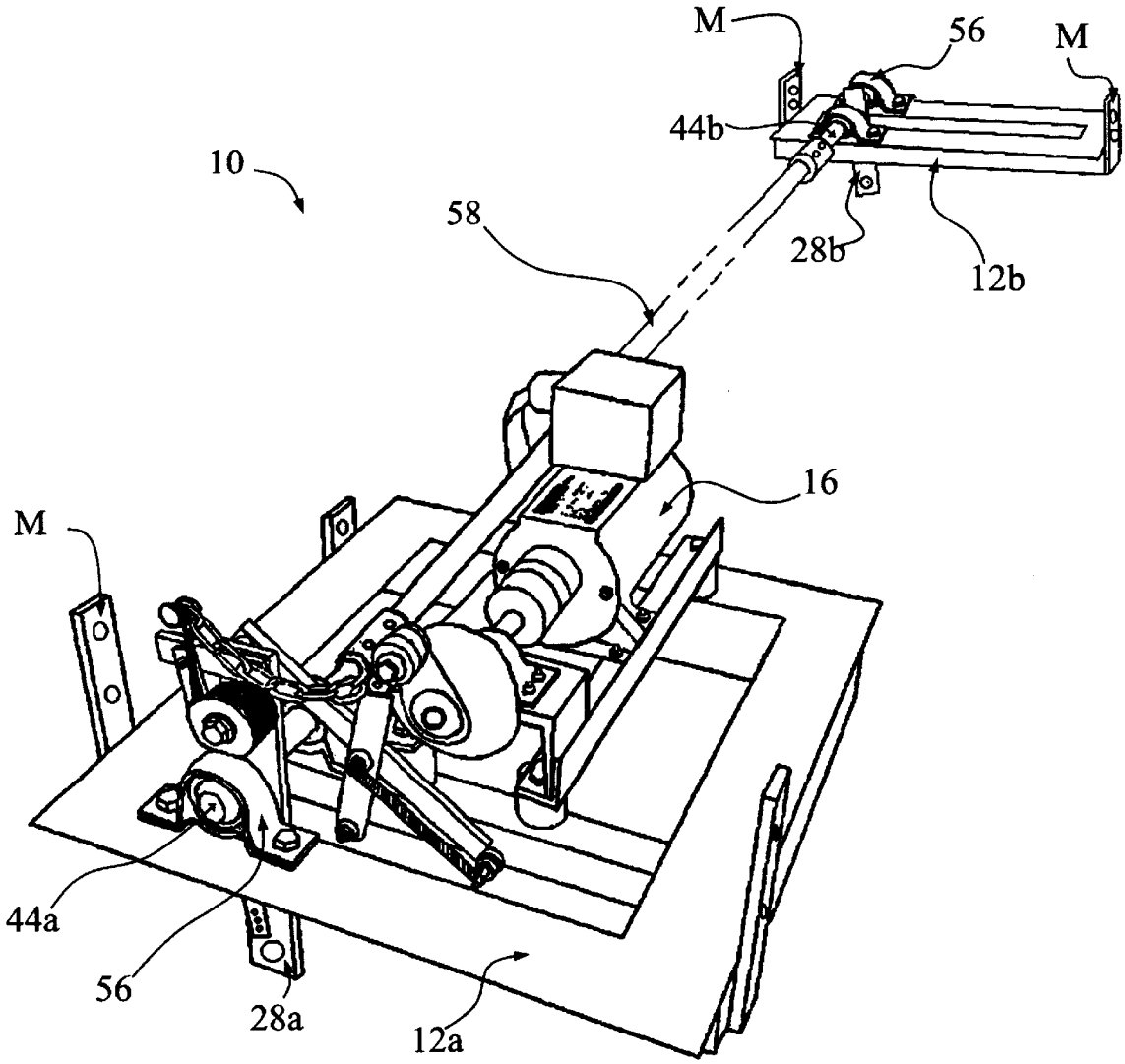
FIG. 1*b* is a perspective view of the automatic swing device of the present invention.
Figure 7A:
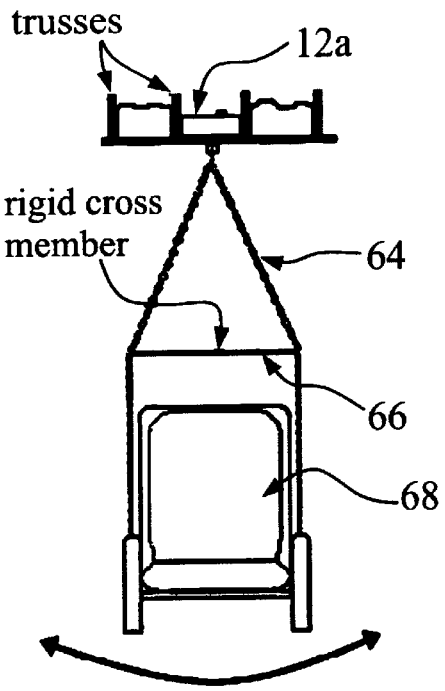
FIG. 7*a* is a front view illustrating the automatic swing device attached to a conventional chair.
Figure 8:
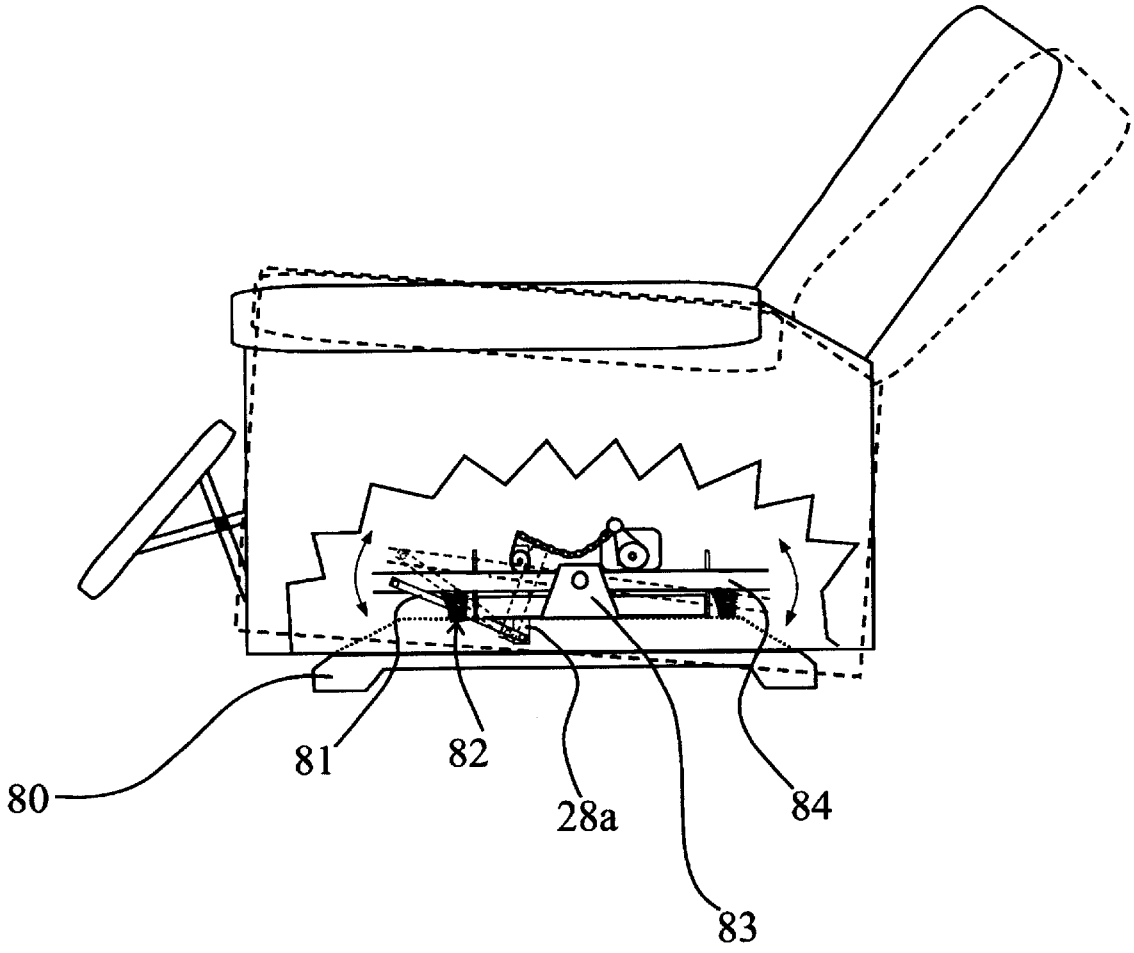
FIG. 8 is a partial side cut-away view illustrating the automatic swing device attached internally within a conventional seat device.

As seen in FIG. 1*b*, the present invention 10 comprises a main frame 12*a* and a floating unit 12*b*. The main frame 12*a* will support the power unit, energy connection element, driven unit and actuating unit of the present invention. In use, in the elevated mode, the main frame 12*a* will be located above and on a first side of the conventional seat while the floating unit will be located above and on the opposite or second side of the conventional seat. It is noted that the main frame can be used alone to support and swing a seat and this configuration is shown in FIG. 7*a*. As seen a singular unit, in combination with a support rod provides the support as well as the swing motion. Alternatively, this main frame can be secured to the base of a conventional seat designed for rocking, so as to provide for a unit that can rock, and thus need not be elevated, as shown in FIG. 8.

When two units, the main frame 12*a* and the floating unit 12*b* are utilized each unit provides a means to fasten the hanging medium, which is used to suspend furniture. The members of the frame structure 12*a* and 12*b* can be conventional angle iron, which has been utilized to produce favorable results. However, it is noted that other material can be utilized so as to provide adequate and efficient support to the components used in the automatic swing device. As seen in FIG. 1*b*, extending upwardly from each frame are frame mounts M. The frame mounts are used to attach each member to a desired support.

The use of two units, main frame 12*a* and floating unit 12*b*, renders an overall apparatus that can be coupled to any conventional seat apparatus, regardless of size and length. In addition, the use of main frame 12*a* and floating unit 12*b* will add to the versatility of the present invention by providing a swinging unit that can be attached to any desired support, such as ceiling beams, A-frame or any form of sound structure. The structure of the mainframe provides a unit that can be use independently, so as to provide for a unit that can be located above or to the base of a conventional seat apparatus; or optionally, the mainframe can be coupled to a floating unit for increasing its usability and attachability.

Figure 2:
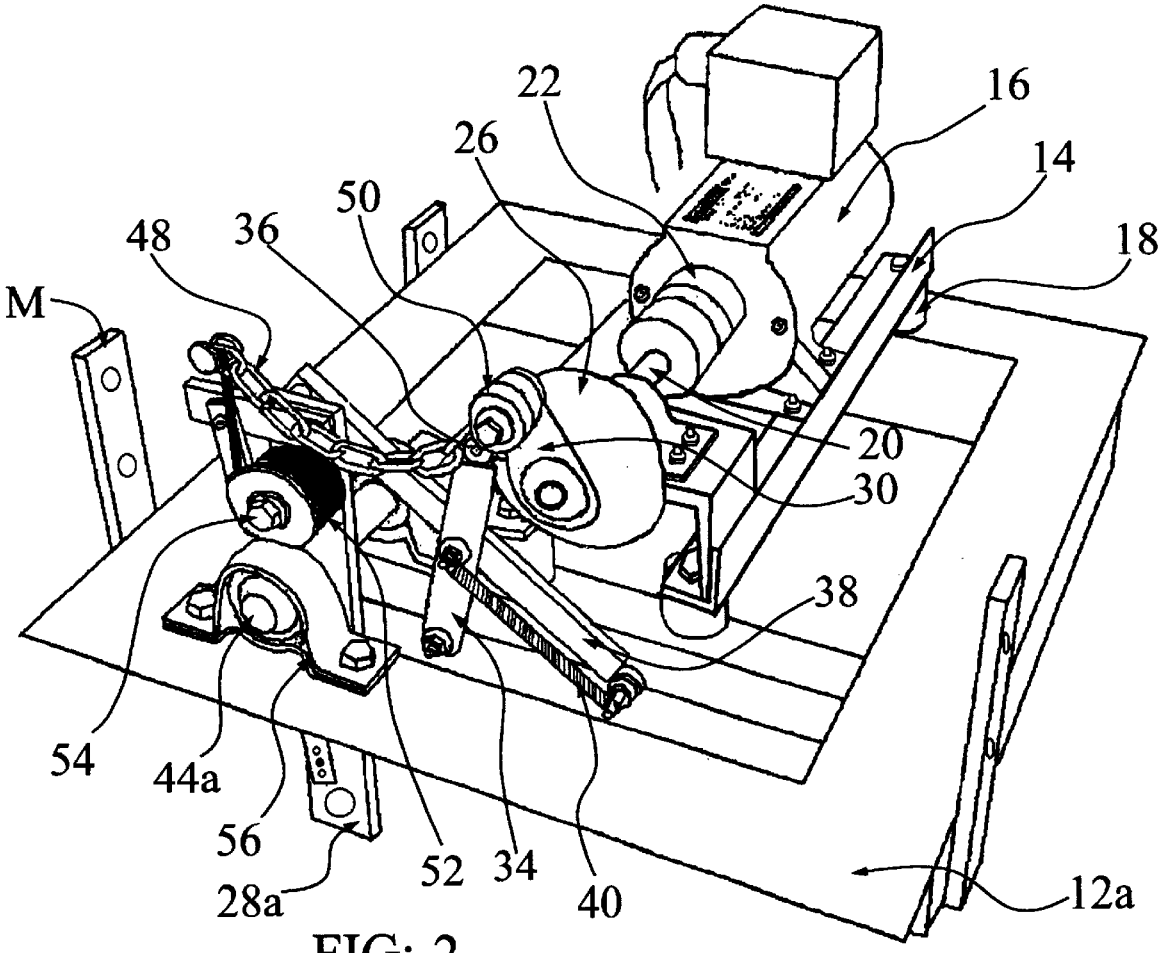
FIG. 2 is a top perspective view of the main driving unit used in the automatic swing device of the present invention.
Figure 3:
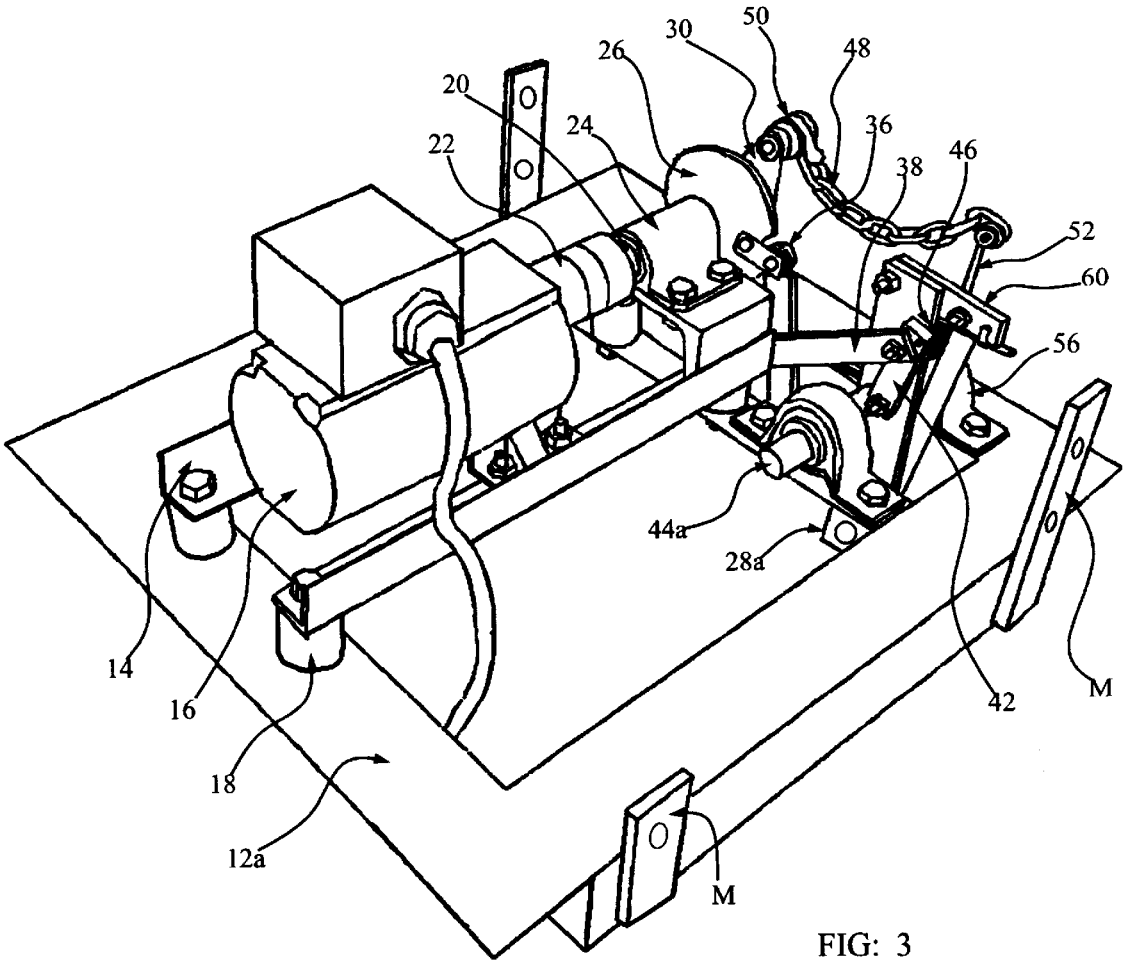
FIG. 3 is a front perspective view of the main driving unit used in the automatic swing device of the present invention.

As seen in FIGS. 1*b*, 2 and 3, the main frame 12*a* comprises a drive support 14. The purpose of the drive support is to maintain the power unit. As seen in the drawings, the power unit is secured to this support via conventional means. The power unit comprises an energy source, such as the use of motor, 16, as illustrated. It is noted that any conventional energy source can be utilized; however a fractional horsepower gear motor has been used to produce favorable results.

To reduce vibration generally associated with the power unit, dampening pads 18 can be utilized. Dampening pads 18 will dampen and absorb the vibrations of the power unit.

The energy source 16, as shown in FIGS. 1*b*, 2 and 3 is connected to a power shaft 20 via a coupling 22. The power shaft 20 extends through a bearing assembly 24 (shown in FIG. 3). From the bearing assembly 24, the power shaft 20 is inserted into a clutch 26.

Figure 7B:
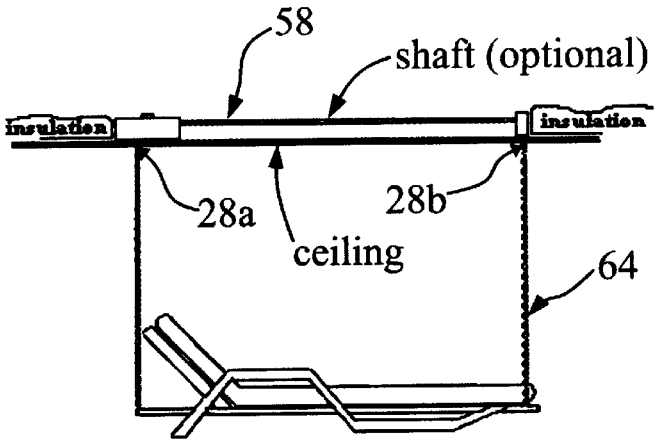
FIG. 7*b* is a side view illustrating the automatic swing device attached to a conventional lounge chair.

In this invention, the energy source, or motor, 16 runs continuously while the clutch 26 transfers power to a hanging arm 28*a*, dependent upon the activation unit (manual or automatic). A hanging arm will be located on each unit, thus providing for a hanging arm to be located on the main frame as well as on the floating unit. The desired item to be supported and swung via the present invention will be secured to the hanging arm by way of a coupling unit, such as the use of a shaft, rope, chain or the like. This configuration is shown in FIG. 7*b*, wherein one end of a chain is secured to the hanging arm and its second end is secured to the lounge chair. Innately providing for the movement of the swing arm to inherently cause the coupling unit to move; thus causing hung item to be swung. Accordingly, it is seen that the gear motor and clutch constitutes the power unit of the present invention. It is noted that other means can be utilized for the energy source, such as, but not limited to: the use of a motor-belt-pulley arrangement; the use of a solenoid; the use of a magnetic system; the use of a ratcheting system; or the like. Thereby providing for any combination for the power unit.

Secured to the output of the clutch 26, shown in FIGS. 2 and 3 is a rotating arm 30. Secured to the outer end of the rotating arm 30 is a bearing 50.

During the operation mode, the clutch 26 is engaged and will cause the rotating arm 30 to rotate, innately causing activation of the swing unit. To enable or disable the clutch 26, an activation unit is utilized. The activation unit comprising a clutch pedal 34 that maintains the clutch control point 36. As seen in FIG. 3, the clutch 26 includes a groove (partially illustrated, but not labeled) for receiving the control point 36. When the control point 36 is located within the groove, the clutch does not rotate. Thus the swing device is in a rest position.

Movement of the clutch pedal 34 is achieved by the use of a horizontal linkage 38. This horizontal linkage 38 is connected to the clutch pedal 34 on one end via a return spring 40 and an activation arm 42 (shown in FIG. 3) on the opposite end.

The activation arm 42 is secured to the hanging arm 28*a* near the main shaft 44*a* and is hinged at this point. Bumper 46 is secured to the top end of the activation arm 42 to provide a means of contact to the hanging arm 28*a* so as to control the linkage movement. Thereby providing for the bumper 46 to dampen impact to the linkage assembly and control movement to the horizontal linkage 38.

As seen in FIGS. 2 and 3, the clutch pedal is in contact with the control point or stop point 36 to provide for a non-operational mode. To enable operation, the clutch pedal 34 is pulled away by the movement of the main frame's hanging arm 28*a*, thus disengaging contact with the stop point 36 and enabling the clutch 26 to rotate and initiate the transferring of power to maintain the swinging motion Initiation of the rotation of clutch 26 occurs when the top of the main frame's hanging arm 28*a* is moving away from clutch 26. This will provide for the hanging arm to strike bumper 46 that is secured to the activation arm 42. Bumping this bumper 46 will provide for the horizontal linkage 38 to pull the clutch pedal 34 away from the stop point on the clutch 26.

The linkage 38 constitutes the actuating unit and thus initiates the energy cycle. The linkage 38 is shown as a mechanical element, but it is noted that other linkage assemblies can be used, such as, but not limited to, the use of electronic sensors, switches or the like.

As illustrated in FIGS. 2 and 3, the energy-connecting element provides a means for conveying energy from the power unit to the main frame's hanging arm 28*a*. Shown, as the energy-connecting element is a chain 48. It is noted that other elements can be utilized, such as cable, bungee cords, chain, rope or the like. For illustrative purposes, a chain is shown. One end of the chain 48 is secured to bearing 50 on the rotating arm and its opposite end of the chain is secured to a torsion spring 52. The torsion spring 52 is fitted over a mandrel 54 and acts as the driven unit. This torsion spring will dampen power to the main shaft. It is noted that other elements can be used to dampen the power to the main shaft. These elements include, but are not limited to compression spring, extension spring, pneumatic cylinder, hydraulic cylinder or the like.

The mandrel 54 is secured to the main frame-hanging arm 28*a*. The torsion spring 52 produces a dampening effect, thus cushioning the forces of the power unit, but allowing the required energy to be transferred to the hanging arm 28*a* in order to maintain the natural swinging rhythm.

The main frame's hanging arm 28*a* is permanently connected to the main shaft 44*a* via conventional means such as welding or the like. This assembly is supported on the main frame 12*a* by inserting each end of the main shaft 44*a* into pillow block bearings 56. This will provide for the main frame's hanging arm 28*a* to be fixed and sandwiched between the bearings (see FIG. 3). The pillow block bearings 56 are secured to the main frame 12*a*. This configuration will provide the main shaft to be supported on the main frame via the bearings, as well as enable the main shaft 44*a* to rotate freely within the bearings. These bearings allow for a very smooth motion to the hanging structure as compared to conventional S-hooks. As seen in FIGS. 1*b*–3, the main shaft extends beyond the bearings so as to enable a coupling to be secured thereto. This coupling is optional and will permit for an optional shaft 58 to be employed. This optional shaft will be used to couple the floating unit with the main frame.

To enhance the present invention, a means of changing the swing angle is provided. This means of adjusting is illustrated in FIGS. 1*b*–3 and 5. As seen, to adjust the swing angle, the distance between the bearing 50 and the torsion spring 52 must be variable. The closer the distance, the smaller the swing angle. The greater the distance, the greater the swing angle. Fitting an adjusting arm 62 into one of the given slots at the bottom of the main frame hanging arm 28*a* forces the spring positioner 60 to change the distance accordingly as shown. Thus, the hanging arm 28 will deviate from vertical center to a lower or higher degree.

When the adjusting arm 62 is set for maximum swing angle and the swing has reached the full distance (top of the main frame hanging arm 28*a* further away from clutch 26) in the backward direction, there is very little slack in the chain 48. Therefore, the main frame's hanging arm 28*a* endures a longer duration of applied force produced by the rotating arms 30 cycle. Therefore, more energy is applied to keep up with the loss by friction over a greater swing angle. Conversely, if the adjusting arm 62 is set for minimum swing angle, there is more slack in the chain 48 and the main frame hanging arm 28*a* endures a lesser duration of applied force produced by the rotating arm 30 resulting in a minimum swing angle. Thus, it is seen that the user controls the swing angle by merely sitting in the seat and swinging to the desired angle so as to set the swing angle and enable continuous swing at that particular chosen angle.

It is noted that a linkage assembly is used for the swing angle adjustment, however, other devices can be used in order to adjust the angle of the swing. These devices include, but are not limited to, CAMS, screws, multi-hole brackets or the like.

Figure 4:
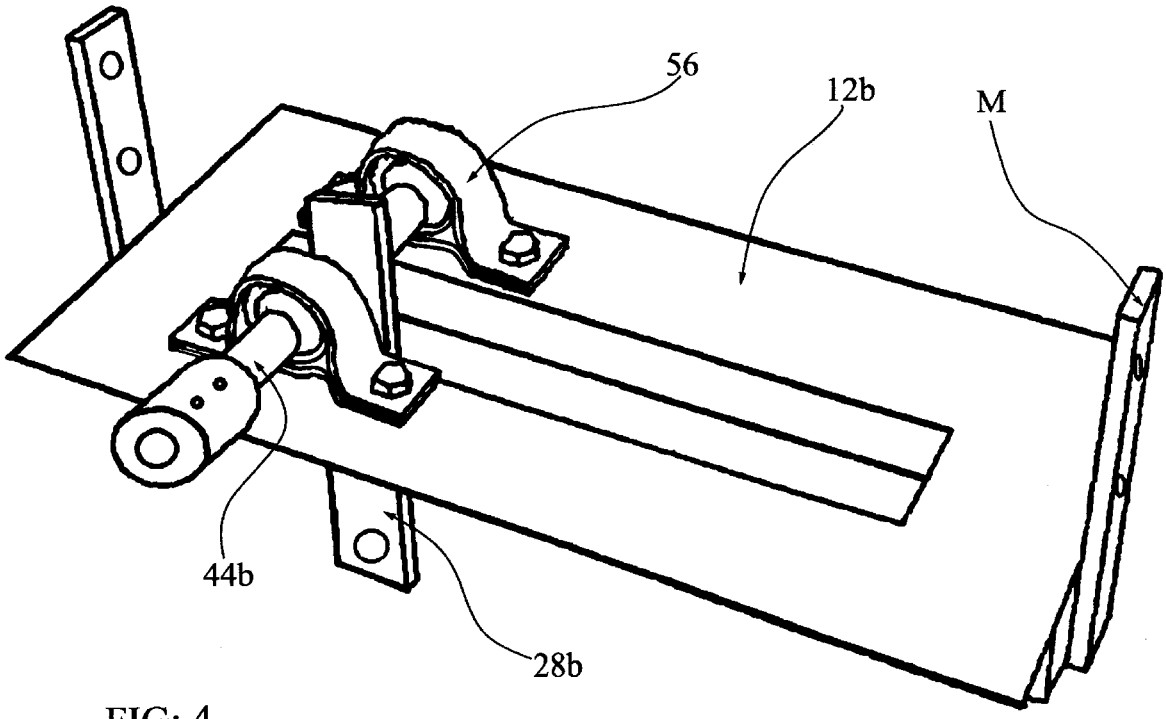
FIG. 4 is an enlarged perspective view of the floating unit used in the automatic swing device of the present invention.
Figure 5:
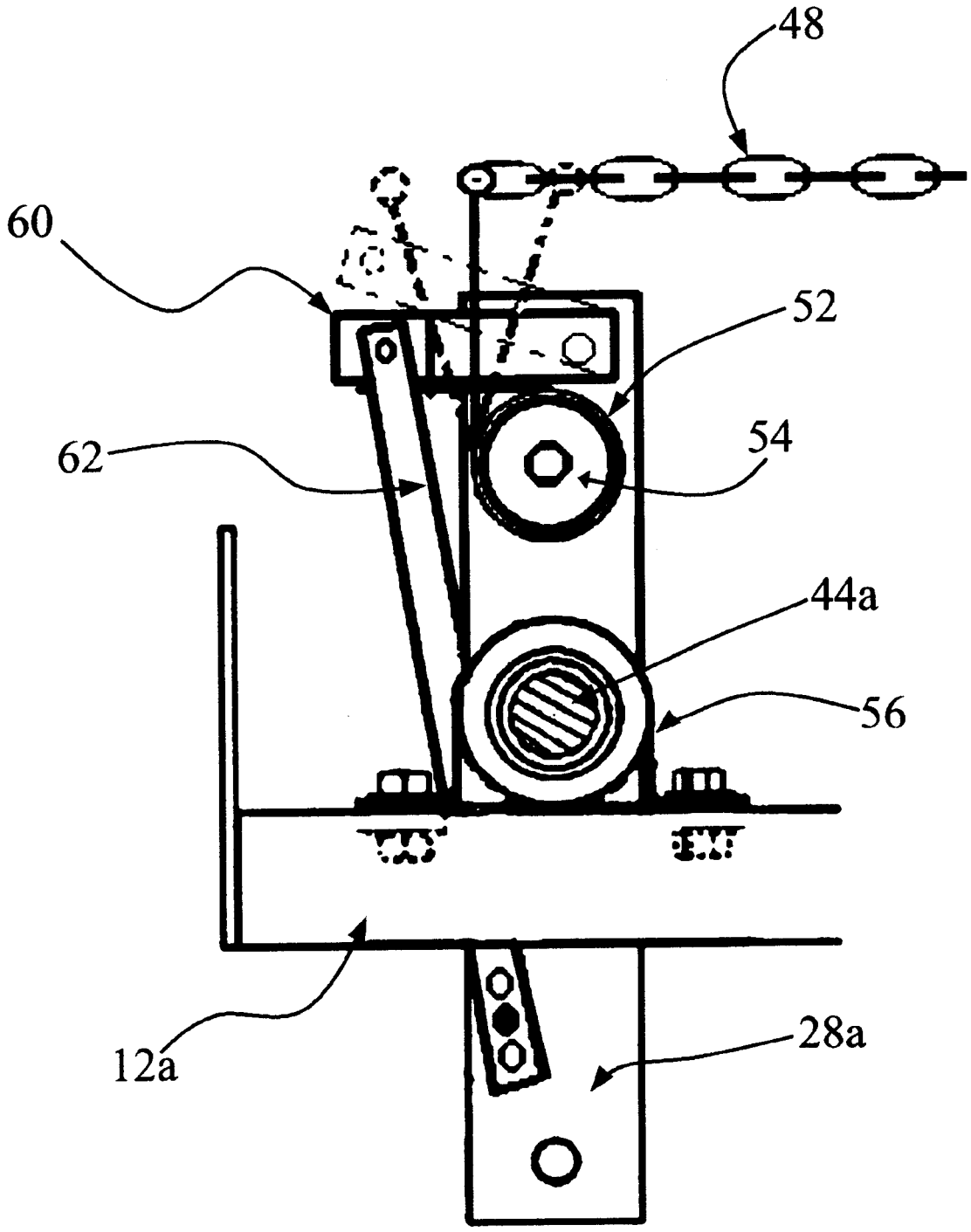
FIG. 5 is a side view of the main driving unit used, illustrating the angle adjusting mechanism used in the automatic swing device of the present invention.
Figure 6:
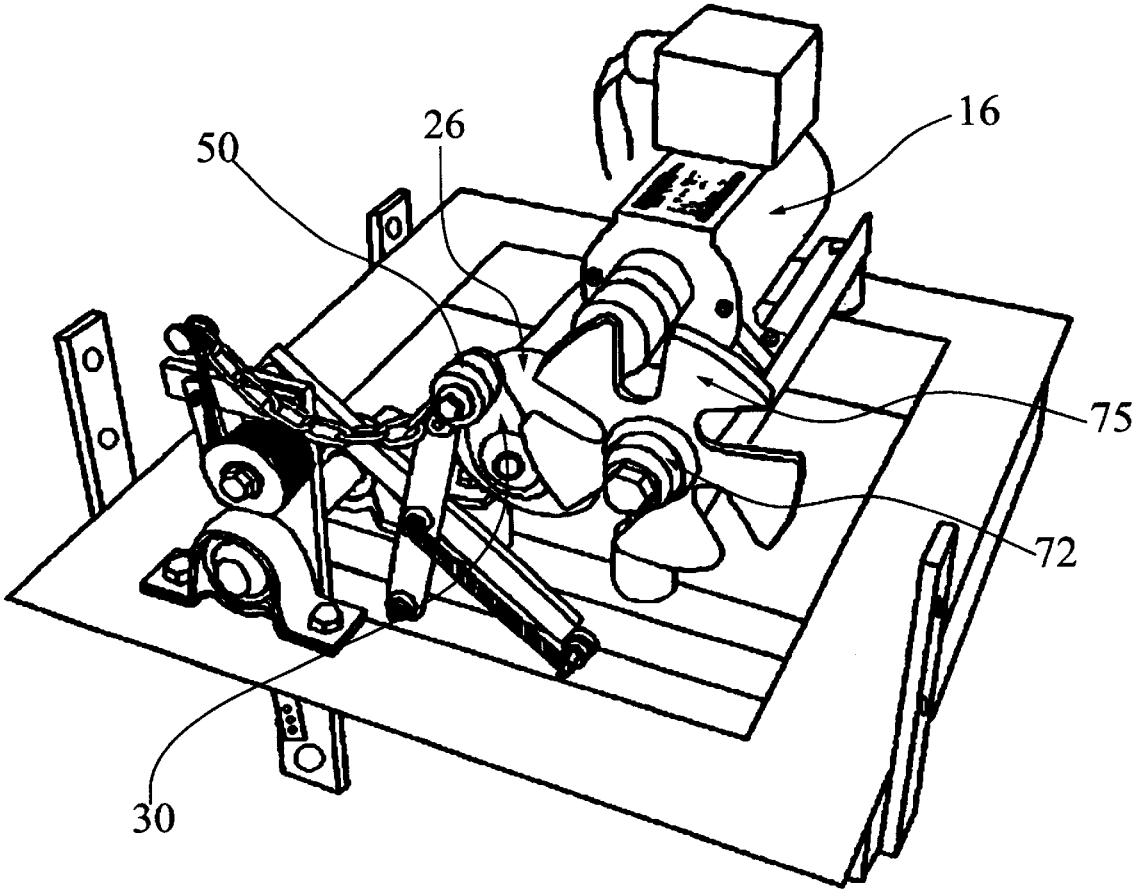
FIG. 6 is an enlarged perspective view of the main driving unit used in the automatic swing device including an anti-back lash device attached thereto.

The floating unit 12*b* can be seen in FIGS. 1*b* and 4 and is used to secure the opposite end of the furniture from the main frame 12*a* side. To configure this, a floating unit hanging arm 28*b* is permanently connected to the floating shaft 44*b* via conventional means, such as welding or the like. This assembly is supported to the floating frame (or floating unit 12*b*) by inserting each end of the floating shaft 44*b* into the pillow block bearings 56 with the floating unit's hanging arm 28*b* sandwiched therebetween. One end of the floating shaft 44*b* extends out beyond the pillow block bearing 56 enough to accept a coupling in the event the optional shaft 58 is employed. This optional shaft will enable coupling between the main frame and the floating device. This configuration of utilization of the optional shaft 58 is shown in FIGS. 6*b* and 6*c*. Each pillow bock bearing 56 is secured to the floating frame 12*b*. This configuration will enable the floating shaft 44*b* to rotate freely about the pillow block bearings so as to allow for the hanging arm to pivot as desired. Mounting brackets M are a part of the floating frame 12*b* and are used to secure the floating frame 12*b* to a support structure. Thus, it is seen that the mounting brackets constitute the attaching assembly.

To illustrate the swing cycle, refer to FIGS. 1*b*, 2, and 3. As the top of the main frame's hanging arm 28*a* is rotating away from the clutch 26, such as when an individual sits on the seat supported by the present invention, and pushes himself back, the clutch pedal 34 releases the clutch 26 through the movement of the horizontal linkage. This will cause for the rotation of the rotating arm 30. The rotating arm 30 is now transferring energy through the chain 48 onto the torsion spring 52, which is secured to the main frame's hanging arm 28*a*.

At this moment, the main frame's hanging arm 28*a* is reversing direction naturally and the force produced on the torsion spring 52 produces the needed energy to maintain a natural swinging rhythm. Meanwhile, the rotating arm 30 will rotate 360 degrees. Full rotation will provide for the unit to complete a cycle. This will innately render for the clutch pedal 34 to be in position to disengage the clutch 26. This is accomplished as the main frame's hanging arm 28*a* passes vertical center and the return spring 40 positions the clutch pedal 34 to receive the stop point 36 on the clutch 26. Thus, returning to the same position every time before the start of the next swing cycle. The RPM of the power unit is selected to be slightly faster than the natural rhythm. This process results in maintaining the correct timing of the invention thereby producing a natural swinging rhythm.

To initiate swinging, the user of the present invention would occupy the furniture coupled to the hanging arms 28, give an initial push and the present invention will automatically maintain a natural swinging rhythm without any effort from the user.

It is noted that the main frame structure as well as the floating unit of the present invention are sized in order to be easily installed in standard building construction practices of ceiling joists on minimum 16 inches on centers. It is further noted that the frame structure can be mounted inside or onto a free standing frame member or any kind of conceivable sound structure.

Other features allow for conventional swinging (without the use the power unit) by eliminating any rigid mechanical connection between the rotating arm bearing 50 and the torsion spring 52. This will provide for the chain to be loosely coupled between the rotating arm bearing and torsion spring. Such a configuration will provide for the chain 48 to move freely and drop down out of the way as the main frame's hanging arm oscillates back and forth. In addition, due to this novel design there is no wear and tear on any of the mechanical components when operating the invention as a conventional swing.

Yet another feature of the present invention allows for the insertion of an optional shaft 58 as shown in FIG. 1*b*, the shaft 58 is fitted and connected to both the main shaft 44*a* and the floating shaft 44*b* by conventional coupling means. The optional shaft 58 will eliminate any wobbling which may be experienced due to the furniture in use would create by the inconsistencies in weight and size from one end to the other.

To further enhance the present invention and to accommodate clutches having backlash characteristics, an anti-backlash apparatus is secured in proximity to the clutch assembly 26. This anti-backlash apparatus is illustrated in further detail in FIG. 6. As seen in this drawing secured to the main frame is a torque limiter 72 having a slotted disc 75 attached thereto. The slots in the disc 75 will receive the bearing 50. As the bearing 50 travels in the slotted disc, a backward force is applied to the rotating arm 30. This applied force prevents the rotating arm from backlashing, and will inherently provide for a clutch system that is substantially noise free. A system that maintains quiet operation adds to the desirability of the final product.

Examples of the various elements that can be attached to the present invention are shown in FIGS. 7*a* through 7*d*. As seen FIG. 7*a* the main frame 12*a* is secured to a structure, in this case the ceiling, and a chain 64 is secured to hanging arm 28. This provides for each end of the chain to be secured to each side of the seat 68. To provide for the chains to be non-obtrusive to the user of the seat, a rigid cross member 66 is provided. This rigid cross member is located above the seat.

Figure 7C:
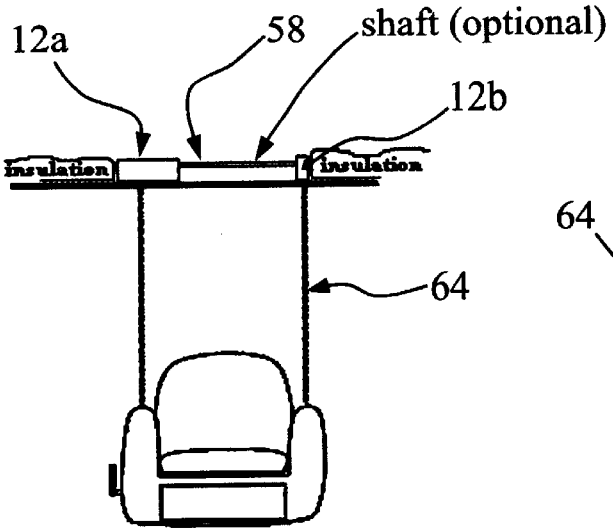
FIG. 7*c* is a front view illustrating the automatic swing device attached to a conventional recliner.
Figure 7D:
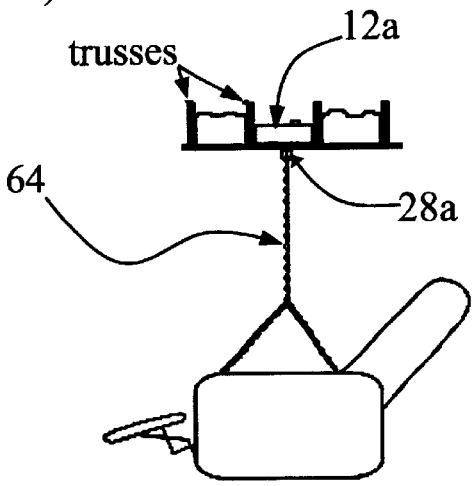
FIG. 7*d* is a side view illustrating the automatic swing device attached to a conventional recliner.

As seen in FIGS. 7*b* and 7*c*, the main frame 12*a* and floating frame member is shown. Coupling the units together is the optional shaft 58. FIG. 7*d* illustrates a side view of the present invention attached to a chair. As seen, the main frame 12*a* is located in the ceiling and a chain is secured to the hanging arm and to the arm of the seat being supported.

An example of a unit that utilizes the present invention in the base of conventional rocking seat is shown in FIG. 8. As seen in this figure, the conventional rocking type furniture comprises a base 80 having a hinge point 83 on which the horizontal cross member of the chair chassis 84, which supports the entire weight of the passenger, pivots. Spring 82 is one of four springs that is manufactured with the chair and keeps the chair level while not rocking. The present invention would be attached to the chair chassis. The lower portion of the hanging arm would be eliminated. A rigid mechanical link 81 would be attached from the upper area of the hanging arm to the base of the chair. The chair-to-hanging-arm link moves upward making the chair rock backwards and thus providing for the automatic rocking motion.

While the present invention has been particularly shown and described with reference to an embodiment thereof, it will be understood by those skilled in the art that various changes in form and detail may be made without departing from the spirit and scope of the present invention.

We claim:

1. An automatic swing device comprising:

a power unit having an attaching element secured thereto;

said attaching element is attachably secured to a conventional seat apparatus;

an energy connecting element;

a driven unit;

an actuating unit;

said energy connecting element couples said power unit to said driven unit;

said actuating unit is coupled to said power unit and said driven unit;

said power unit produces a pushing or pulling force;

said energy connecting element transfers power from said power unit to said driven unit;

said driven unit dampens power of said power unit for providing a smooth pushing or pulling force; and said actuating unit initiates power unit for providing for a natural swinging or rocking motion of said conventional seat apparatus.

2. An automatic swing device as in claim 1 wherein a swing angle adjustment device is coupled to said driven unit for enabling a user to adjust angle path of a swing pattern.

3. An automatic swing device as in claim 1 further comprising a length-adjusting device for enabling said automatic swing device to be attached to any length seat apparatus.

4. An automatic swing device as in claim 1 wherein said power unit comprises a gearmotor and clutch assembly, said gear motor controls said clutch assembly and said clutch assembly forces said energy connecting element to move for forcing said actuating unit to complete a swing cycle.

5. An automatic swing device as in claim 1 wherein said energy connecting element is a chain.

6. An automatic swing device as in claim 1 wherein said driven unit is a spring.

7. An automatic swing device as in claim 1 wherein said power unit is coupled to a main frame, said main frame includes mounting brackets for enabling said main frame to be secured to a desired surface.

8. An automatic swing device as in claim 1 wherein said actuating unit includes a hanging arm, said hanging arm is coupled to said conventional seat apparatus for enabling said conventional seat apparatus to swing via said hanging arm.

9. An automatic swing device comprising:

a power unit;

an energy connecting element;

an actuating unit having an attaching element secured thereto;

said attaching element enables attachable attachment to a conventional seat apparatus;

said energy connecting element couples said power unit to said actuating unit; said power unit produces a pushing or pulling force;

said energy connecting element transfers power from said power unit to said driven unit; and said actuating unit initiates said power unit for providing for a natural swinging or rocking motion of said attaching element for enabling swinging or rocking motion of said conventional seat apparatus.

10. An automatic swing device as in claim 9 further comprising a length-adjusting device for enabling said automatic swing device to be attached to any length seat apparatus.

11. An automatic swing device as in claim 9 wherein a driven unit is coupled to said actuating unit and said driven unit dampens power of said power unit for providing a smooth pushing or pulling force.

12. An automatic swing device as in claim 9 wherein a swing angle adjustment device is coupled to said driven unit for enabling a user to adjust angle path of a swing pattern.

13. An automatic swing device as in claim 9 wherein said actuating unit is located above said conventional seat apparatus.

14. An automatic swing device as in claim 9 wherein said actuating unit is secured to said base of a conventional seat apparatus.

15. An automatic swing device as in claim 9 wherein a first frame member maintains said power unit, said energy connecting element and said actuating unit.

16. An automatic swing device as in claim 15 further including a second frame member having a second attaching element for enabling said first frame member to be located on a first side of said conventional seat apparatus and said second frame member to be located on a opposite and second side of said conventional seat.

17. An automatic swing device as in claim 16 wherein a shaft connects said first frame member to said second frame member.

* * * * *